US005515342A

United States Patent [19]

Stearns et al.

[11] Patent Number: 5,515,342

[45] Date of Patent: May 7, 1996

[54] DUAL FREQUENCY SONAR TRANSDUCER ASSEMBLY

[75] Inventors: Cleo M. Stearns, Jamesville; David J. Erickson, Liverpool; Louis M. Izzo, Fayettesville, all of N.Y.

[73] Assignee: Martin Marietta Corporation, Syracuse, N.Y.

[21] Appl. No.: 377,506

[22] Filed: Jul. 10, 1989

Related U.S. Application Data

[63] Continuation-in-part of Ser. No. 288,489, Dec. 22, 1988, abandoned.

[51] Int. Cl.[6] ..... H04R 17/00

[52] U.S. Cl. ..... 367/155; 367/158; 310/334

[58] Field of Search ..... 367/158, 155, 367/157, 165; 310/334

[56] References Cited

U.S. PATENT DOCUMENTS 3,952,216 4/1976 Madison et al. .

4,373,143 2/1983 Lindberg ..... 367/155

*Primary Examiner*—J. Woodrow Eldred

*Attorney, Agent, or Firm*—Paul Chekovich; Stephen A. Young

[57] ABSTRACT

The invention relates to a dual frequency sonar transducer assembly which may be operated at low and/or high frequencies in a sonar array. The assembly comprises a low frequency unit of tonpilz design including a low frequency driver, a low frequency tail mass and a composite head mass, the composite head mass acting as a single low frequency water driving piston and comprising a plurality of high frequency units forming individual high frequency water driving pistons. The high frequency units are also of tonpilz design, with independent drivers, independent head masses, and a common tail mass. The use of a common tail mass simplifies the design without compromising high frequency operation. The design leads to more efficient operation at both frequencies by minimizing the head mass to tail mass ratios.

4 Claims, 2 Drawing Sheets

10
11
11
12
12
13
14
15
15
16
17
22
24
25
27
9

DUAL FREQUENCY SONAR TRANSDUCER ASSEMBLY

CROSS REFERENCE TO RELATED APPLICATION

This application is a Continuation-In-Part of U.S. application Ser. No. 07/288,489, filed Dec. 22, 1988, now abandoned, on the invention of Stearns, Erickson and Izzo, entitled "DUAL FREQUENCY SONAR TRANSDUCER ASSEMBLY".

BACKGROUND OF THE INVENTION

1. Field of the Invention

The invention relates to sonar transducers for use in sonar arrays, and more particularly to a dual frequency sonar transducer assembly which may be operated at low and/or high frequencies in a sonar array.

2. Prior Art

A sonar transducer is a device for generating sound and sensing sound in water. A sonar transducer is at heart a resonator which in the case of ceramic sonar transducers, includes an electroded ferroelectric member. The application of electrical potentials to the electrodes excites mechanical motion in the ferroelectric member used to generate sound waves in the water, and mechanical forces exerted upon the ferroelectric member by sound waves in the water is used to generate an electrical potential in the electrodes to sense the sound.

A common form of sonar transducer includes a "stack" of ring shaped drivers, electrically connected in parallel, clamped by means of a stress rod between a tail mass, which is relatively heavy, and a head mass, which constitutes a relatively light, water driving piston. The tail mass, ceramic stack, and head mass form a two mass resonator assembly. The arrangement desirably produces small amplitude vibrations in the tail mass and large amplitude vibrations of the head mass which acts as a water driving piston.

A transducer is referred to as a "tonpilz" design when the resonator at its heart has the lumped elements described above. The tonpilz resonator may be distinguished from quarter wave and half wave resonators in its use of lumped elements as opposed to distributed elements. In mechanics, the elements which define the resonant properties of an ideal resonator are masses, springs, and sources of loss. Neglecting losses, the tonpilz resonator may be regarded as having a central spring—the driver resilience, and two masses—the head mass and tail mass. The half wave resonator, a practical example of a distributed design in a sonar transducer, consists of a simple monolithic member of ferroelectric material in which the mass and resilient (spring) properties are distributed through the member.

The half wave resonator with its distributed design is often less desirable than a lumped element tonpilz design in which the properties of the lumped elements may be individually optimized. For instance, by adding a dense head mass and tail mass to a ferroelectric driver of conventional density and compliance in a longitudinal mode tonpilz design, one may achieve a shorter length than can be achieved in a half wave resonator. In the half wave resonator operating at the same frequency, the same ferroelectric material is used to provide both the distributed mass and the distributed resilience. With the densities of available ferroelectric materials being less than those of metals usable for masses, the half wave longitudinal resonator is necessarily longer than the tonpilz resonator.

The tonpilz transducer is a relatively narrow band, resonantly operated, single frequency device. It is often desirable to have additional operating frequencies beyond a single fundamental frequency, which is generally all that is available. The advantage of a multiple frequency transducer, if compatible with assembly into a sonar array,is greater versatility. Since a lower frequency may provide greater detection range, and a higher frequency greater spatial resolution, a transducer which operates on two appropriately selected frequencies is of substantial value and requires no additional aperture area than would be required for an array operating on a single frequency.

SUMMARY OF THE INVENTION

Accordingly it is an object of the invention to provide an improved sonar transducer.

It is another object to provide a sonar transducer capable of operation at lower and/or higher frequencies.

It is still another object to provide an improved sonar transducer employing tonpilz transducers for low and/or high frequency operation.

It is an additional object of the invention to provide an improved sonar transducer assembly using a low frequency transducer and multiple high frequency transducers all of tonpilz design in which the low frequency head mass is fully utilized in the multiple high frequency transducers and both low frequency and high frequency transducers are of minimum mass relative to the corresponding tail mass.

These and other objects of the invention are achieved in a novel sonar transducer assembly capable of operating at predetermined low and/or high frequencies.

The transducer assembly comprises a low frequency transducer including a low frequency driver, a composite head mass for providing efficient coupling of low frequency waves to/from the water, a low frequency tail mass more massive than the head mass, and a stress rod for attaching the low frequency head mass to the low frequency tail mass with a sustained compressive stress on the driver.

The composite head mass is itself composed of a plural set of high frequency transducers, the set comprising a set of high frequency drivers, and a set of high frequency head masses designed for efficient acoustic coupling of both high and low frequency waves to the water. The composite head mass further includes a shared, unitary, rigid, high frequency tail mass, more massive than the high frequency head masses, and a set of stress rods for maintaining compressive stresess on each of the high frequency drivers.

When the low frequency driver is excited, the composite head mass, including the high frequency head masses become a virtual single rigid unit, and acts as a single water driving piston. When the high frequency drivers are separately excited, then each high frequency head mass operates separately. Low and high frequency operation may be achieved separately or jointly, the latter being possible if suitable isolation is provided in the electrical quantitites, and means are provided to achieve substantially linear operation.

The arrangement is efficient, given the dual frequency requirement, in that the low frequency head mass is completely utilized to form the high frequency head mass, driver and tail mass and so both the low frequency and high frequency head masses may have a minimum ratio to the corresponding tail masses.

DESCRIPTION OF THE PREFERRED EMBODIMENT

Figures 1A, 1B, 1C:
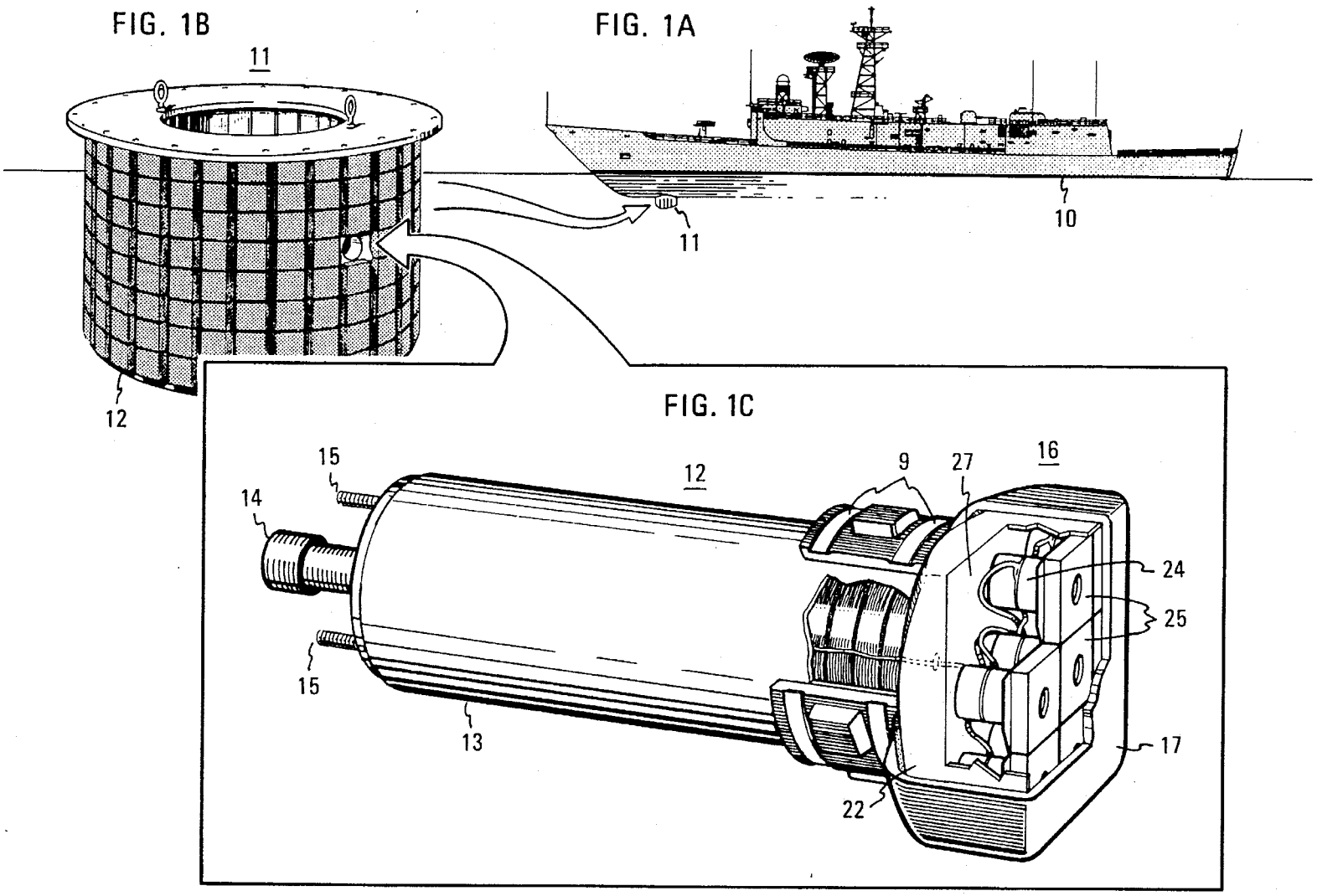
FIG. 1A is an illustration of a surface ship having an array of sonar transducers.
FIG. 1B is an illustration of the array to which the present invention has application.
FIG. 1C is a cut-away view of an individual dual frequency transducer in accordance with the invention for use in the array.

Referring now to FIG. 1A, a surface ship 10 is shown employing a shipborne array 11 of electronically scanned sonar transducers. The present novel dual frequency transducer is of application to this type of array.

The array 11 is immersed in the water and extends beneath the flat bottom of the hull of the surface ship bearing it, so as to permit an unobstructed sweep for outgoing and incoming sonar signals. The sonar coverage extends around an azimuth of 360°, and covers a zone from the horizontal to typically 45° below the horizontal.

The exemplary array, better seen in FIG. 1B, is of a cylindrical configuration, and typically consists of a number (e.g. 36) of vertical rows of transducers 12, one spaced every 10° about the azimuth. Each vertical row contains a smaller number (e.g. 8) transducers.

The advantage of dual frequency operation is greater sonar system versatility. The advantage of the lower frequency (e.g. several kiloHertz), given a limited size for the array, is one of detection range, while the advantage of the higher frequency (e.g. three times higher) is greater spatial resolution. The present invention has primary application to active sonar systems which use resonant transducers to get maximum transmit power and sensitive, low noise, sensing of the echo return. Such resonant transducers are relatively narrow band devices. The invention also may be employed in passive systems, where the dual frequencies selected for narrow band sensing are selected in relation to known target signatures.

The cylindrical array, which consists of typically 36×8 transducers, is conventionally electronically steered and uses conventional beamforming techniques. Each sonar beam in both the low frequency and high frequency mode, is normally formed using a plurality of transducers in the transmit and receive mode. When the transmit and receive signals are properly weighted, using beamforming techniques, both signal to noise ratio improvements and directionality improvements result.

Figure 2:
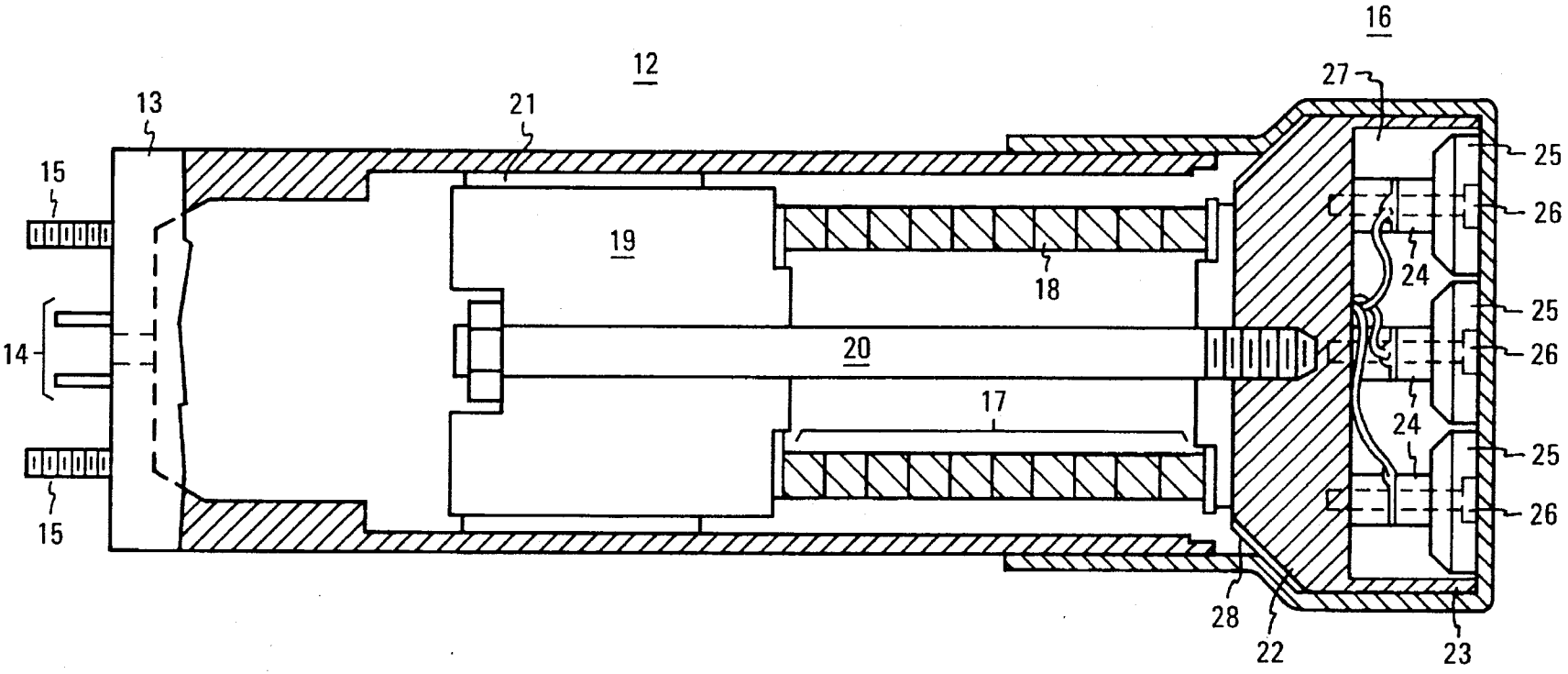
FIG. 2 is a simplified cross-sectional view of the novel dual frequency transducer, supplied to illustrate the underlying principles of the mechanical design.

A novel sonar transducer 12, which possesses a dual frequency capability, and which is suitable for use in a sonar system of the kind described, is illustrated in the broken away view of FIG. 1C and in the simplified cross-section view of FIG. 2.

The transducer 12 is designed for operation with the head immersed. The assembly includes a sealed cylindrical casing 13 having an opening at one end for the transducer elements and head, and a base at the other end at which electrical and mechanical connections are made. An electrical connector 14 and mounting lugs 15 at the base of the casing 13 provide the electrical connections and the means for mounting the transducer assembly upon the frame of the array.

The dual frequency transducer head 16 is fitted into the open end of the casing 13, and is sealed to the casing by means of a rubber boot 17. The boot is necked down at the opening of the casing to provide an overlapping fit. The sealing to the casing is completed by means of two tightened metal bands 9 which compress the overlapping rubber against the casing.

The active parts of the dual frequency transducer are best seen in FIG. 2. The transducer is of a longitudinal mode mass loaded tonpilz design, driven at the lower frequency by a stacked ferroelectric resonant driver 17. The driver 17 consists of a plurality (e.g. 10) of hollow cylindrical rings 18 of a suitable ferroelectric ceramic material such as lead zirconate titanate (Navy Type III). The individual rings are electroded top and bottom to create electric fields parallel to the axis of the driver when a voltage is applied. Conversely the poling efficiently converts axial stresses to voltages. The driver material is polarized in the same, axial direction, and thus utilizes the $k_{33}$ electro-mechanical coupling coefficient.

The electrical connections, which are not shown, connect the members 18 of the driver stack in parallel for both transmission and reception to reduce the absolute voltages. The connecting wires pass down around the other parts of transducer, exiting at the base of the housing via the connector 14.

The transducer, when operated in the low frequency mode may be viewed as a four piece tonpilz resonator consisting of a driver 17, a head mass 16, a tail mass 19 and a stress rod 20.

The driver 17, which has just been described, is a ferroelectric member which compresses and expands axially with applied axial fields. Being of high "Q", low loss material, axial vibratory motion is sustained with a relatively modest supply of electrical energy. In the process of sound transmission, the driver absorbs electrical energy from the power supply and converts it into mechanical energy to drive itself and the other members of the resonator. In simple longitudinal vibration, a driver without attached masses, might be supported about its mid-section. In such a case the center would become a node and the two ends would become anti-nodes, making the device a half wave longitudinal mode (or expander) resonator. As earlier pointed out, the half wave resonators are generally less attractive than mass loaded (tonpiltz) resonators, due in part to the fact that the resultant length of a low frequency half wave length resonator becomes excessive and also results in narrower bandwidth operation.

Resonant operation of the four piece tonpilz resonator is constrained by the selection of a relatively massive "tail mass" 19, as it is called, which provides a reactive termination to the driver and establishes a defacto node with minimum motion near one end of the ceramic driver. The resonator is provided with a relatively lighter "head mass" (16) acting as a force transformer which moves as a rigid body or piston in transferring mechanical motion to the immersing water. When the two masses are greatly dissimilar, the resonator is constrained to operate in a longitudinal or length expander mode, with the heavy tail mass near the node exhibiting relatively small excursions and the relatively light "head mass" exhibiting maximum excursions. The low frequency resonator also requires a stress rod 20, which is fastened between the tail mass 19 and the head mass 16 and passes through the driver 17. The stress rod is tightened to the point that it always exerts a compressive force on the driver 17. The mechanical design of the low frequency resonator must take into account both the masses and the elastic properties of all four members. The tail mass is usually trimmed to set the operating frequency of the transducer.

The resonator is mounted in a manner not absorbing excessive energy. This is achieved by supporting the resonator primarily by means of the tail mass, which is resiliently mounted at 21. The tail mass, while not free of vibration, vibrates at a greatly reduced amplitude, and causes relatively little energy to be absorbed in the support structure.

In the low frequency mode, the head mass 16 operates as a single rigid member reciprocating axially in the manner of a piston. This motion takes place unaffected by the features facilitating dual frequency operation.

In this embodiment the head mass consists of a cup-shaped base having a thickened bottom 22 and relatively thin outer walls 23 which extend to its outer face. Nine small high frequency drivers 24, arranged in a three by three matrix like arrangement are spaced over the surface enclosed by the walls 23 and are supported on the thickened bottom 22. The nine high frequency drivers 24 are provided with nine square high frequency head masses 25, which are disposed in a common plane and which form the outer face of the transducer. The high frequency head masses 25 are attached to the drivers 24 by means of individual stress rods 26. The stress rods (bias bolts) 26 have heads engaging the head masses 25 and pass through the drivers 24 and are threaded into the base 22 and tightened to clamp these elements together and sustain a continuing compressive stress. The high frequency head masses 25 provide a lighter loading to the individual high frequency drivers 24 than the relatively heavy high frequency tail mass (partly) provided by the base 22. Thus in the high frequency mode, the high frequency drivers excite a length expander mode with minimum excursions in the base 22 and maximum excursions in the high frequency head masses 25.

Returning now to low frequency operation; the elements making up the head mass are rigid and collectively, they are capable of moving as a rigid piston as stated earlier. This is due to the fact that the members 22–26 are sufficiently stiff. Thus, axial motion induced by the low frequency driver 17 causes the bottom 22 of the head mass to move axially. The bottom 22 is sufficiently rigid to cause uniform axial motion of the total surface, and the drivers spaced over the bottom 22 also move with uniform axial motion. Assuming no electrical excitation applied to the high frequency drivers 24, and since they are of substantial cross-section, they are also rigid. The rigid drivers 24, in turn drive the high frequency head masses 25, which are of a thick cross-section and are also rigid. Collectively the head masses 25 form the rigid surface of the low frequency piston. Thus, during low frequency operation, and assuming no high frequency excitation, the head mass 16 operates as a rigid piston.

In high frequency operation, the low frequency tail mass 19, and low frequency driver 17, as well as the base 22 forming a portion of the low frequency head mass contribute positively to the effective high frequency tail mass in establishing a resonant, length expander mode.

Each high frequency driver 24 may be separately energized and the signals fed to each driver. The separate connections to the high frequency drivers pass down through the assembly and exit at the base connector 14. These separate connections allow for greater freedom in steering the high frequency beam.

The use of the base 22 as a common tail mass for all the high frequency transducers is a useful feature, simplifying the overall design.

The base 22 is sufficiently massive to permit substantial decoupling between the high frequency transducers and to allow independence between transducers in beam formation in both the listening and transmitting modes.

In addition, high operation places no excess mass in the low frequency head mass beyond that required for the high frequency transducers per se. In other words, the plural high frequency head masses, the common high frequency tail mass, the plural drivers and the plural stress rods form the low frequency head mass, and constitute it entirely. No additional head mass structure is required to mount the individual high frequency transducers or to provide for mutual isolation. In addition, the common high frequency tail mass is of a simple design requiring the relatively few machine operations to attach the stress rods which hold the high frequency transducers in place. Conversely, all of the low frequency head mass is available to provide the elements of the high frequency transducers. The arrangement thus allows one to minimize the head mass to tail mass ratio in both the high frequency and low frequency modes, and thus maximize transducer efficiency and sensitivity.

The foregoing dual frequency sonar transducer may be assembled in the following manner. The head commencing with the cup shaped base 22, 23, is assembled first. An optional syntactic foam block 27 may be formed to fill the void between the base 22, 23, the head masses 25 and the ferroelectric drivers 24 for the purpose of preventing the admission of encapsulant during assembly or in deep submersion applications. The low density foam block 27 fills the gaps between the drivers and permits the low frequency head mass (formed of the members 25) to be moved forward without a substantial increase in mass. Another technique for preventing the admission of encapsulant during assembly and for protection of the interstices during high pressure application is to bond a thin membrane across the low frequency head mass extension 23 and over the high frequency head masses 25. A material useful for this purpose is G-10 fiberglass board.

A thin corprene release material 28 is provided behind both the low (22) and the high frequency (25) head masses so as to provide isolation from the water proofing material and internal fill material, and avoid inhibition of longitudinal motion. The high frequency head masses 25 are drilled and countersunk on the front faces so that the stress rods (bias bolts) 26 for these units may be inserted through the high frequency head masses and tightened into the base 22, 23. The stress rods are adjusted to place the high frequency ceramic stacks in compression between the base 22, 23 and the head masses 25.

Once the high frequency transducers are assembled in the head mass assembly, the assembly is water-proofed. One may use either a layer of polyurethane cast over the unit or a vulcanized Neoprene layer as illustrated to waterproof the unit. The low frequency ceramic stack, tail mass and stress rod are then added to the head mass assembly and installed into the casing to complete the dual frequency unit. In some cases it may be more convenient to do the complete assembly before doing the waterproofing.

While a square n×n array of high frequency head masses, where n=3, has been illustrated; a rectangular m×n arrangement, where m and n are unlike integers may be used depending on the application. In general, the high frequency head masses should fill the aperture and create a continuous surface for the low frequency head mass. This may be carried out using square, hexagonal or rectangular high frequency head masses. The low frequency head mass may take a shape permitted by a compact assembly of the high frequency head masses. A rectangular arrangement with unequal face dimensions (for either the high frequency or low frequency head mass) is advantageous when the beam is required to have a different width on two orthogonal axes. The designs of the high frequency and low frequency head masses need not have the same directional characteristics. For example, an m×n array of square high frequency head masses may be arranged in a rectangular arrangement. Optionally an n×n array of rectangular high frequency head masses may be arranged in a rectangular arrangement where both have the same directional characteristics.

While the foregoing description of the low frequency and the high frequency states of operation has assumed that the other state was inactive, such an assumption is not necessary. Simultaneous and independent operation between the high frequency and low frequency sections is also practical. The electrical quantities must be isolated by suitable filtering in the receive and transmit modes. Device non-linearity causes some mixing and proper design is required to optimize that independence. An array of such dual frequency transducers, with proper isolation, permits two unrelated sonar operations to be performed in a single array, effectively providing the operation of two substantially independent arrays.

What is claimed is:

1. A mass loaded, length expander, sonar transducer for operation in one of three modes including low frequency, high frequency, simultaneous low and high frequency operation comprising A. a low frequency transducer comprising:

(i) a low frequency resonant ferroelectric driver arranged on the principal transducer axis and designed for vibration in a longitudinal mode during low frequency operation, (ii) a composite head mass including a unitary rigid member, arranged on said principal axis outwardly of said low frequency driver for providing a low frequency force transformer and piston for efficient bidirectional coupling of low frequency waves with the water, (iii) a low frequency tail mass, more massive than said head mass, arranged on said principal axis inwardly of said low frequency driver for reactively loading said low frequency driver for vibration in a longitudinal mode with said composite head mass incurring relatively large excursions, and said tail mass relatively small excursions during low frequency operation, (iv) a stress rod engaging to said unitary rigid member for attaching said head mass to said tail mass for sustaining a compressive stress on said low frequency driver throughout operation, B. said composite head mass, comprising a plural set of tail mass mounted, high frequency transducers comprising (i) a set of high frequency resonant ferroelectric drivers arranged on secondary axes parallel to said principal axis and designed for vibration in a longitudinal mode during high frequency operation, (ii) a set of discrete high frequency head masses, arranged on said secondary axes outwardly of said high frequency drivers for providing force transformers and pistons for efficient bidirectional coupling of low and high frequency waves with the water, (iii) a unitary, rigid, high frequency tail mass consisting of said unitary rigid member arranged on said principal axis inwardly of said set of high frequency drivers, said high frequency tail mass being more massive than said high frequency head masses for reactively loading said set of high frequency drivers for vibration in a longitudinal mode with said high frequency head masses incurring relatively large excursions and said unitary high frequency tail mass incurring relatively small excursions during high frequency operation, and (iv) a set of stress rods, each attaching a high frequency head mass to said unitary rigid member of said unitary high frequency tail mass for maintaining a compressive stress on each of said high frequency drivers, said unitary rigid member in providing the head mass of the lower frequency driver, and the common tail mass and means for support of the high frequency driver providing enhanced tail mass to head mass ratios at both low and high frequencies, said low frequency drivers when excited, driving said composite head mass including said set of high frequency head masses as a virtual single unit, and said high frequency drivers when excited, driving each member of said set of high frequency head masses separately.

2. The dual frequency sonar transducer set forth in claim 1 wherein said set of high frequency resonators has $n^2$ members, where n is an integer greater than one.

3. The dual frequency sonar transducer set forth in claim 1 wherein said set of high frequency resonators has m×n members, where m and n are unequal integers.

4. A mass loaded, length expander, sonar transducer for operation in one of three modes including low frequency, high frequency, simultaneous low and high frequency operation comprising A. a low frequency tonpilz transducer comprising:

(i) a low frequency resonant ferroelectric driver, (ii) a composite head mass including a unitary rigid member, arranged outwardly of said low frequency driver for efficient bidirectional coupling of low frequency waves with the water, (iii) a low frequency tail mass, more massive than said head mass, arranged inwardly of said low frequency driver, (iv) a stress rod affixed to said unitary rigid member for attaching said head mass to said tail mass, B. said composite head mass, comprising a plural set of tail mass mounted, high frequency tonpilz transducers comprising (i) a set of high frequency resonant ferroelectric drivers, (ii) a set of discrete high frequency head masses, arranged outwardly of said high frequency drivers for efficient bidirectional coupling of low and high frequency waves with the water, (iii) a unitary, rigid, high frequency tail mass consisting of said unitary rigid member arranged inwardly of said set of high frequency drivers, said high frequency tail mass being more massive than said high frequency head masses, and (iv) a set of stress rods, each attaching a high frequency head mass to said unitary rigid member of said unitary high frequency tail mass for maintaining a compressive stress on each of said high frequency drivers, said unitary rigid member in providing the head mass of the lower frequency driver, and the common tail mass and means for support of the high frequency driver providing enhanced tail mass to head mass ratios at both low and high frequencies, said low frequency drivers when excited, driving said composite head mass including said set of high frequency head masses as a virtual single unit, and said high frequency drivers when excited, driving each member of said set of high frequency head masses separately.

* * * * *